US011543126B2

(12) United States Patent
Shaw

(10) Patent No.: US 11,543,126 B2
(45) Date of Patent: Jan. 3, 2023

(54) METHOD AND APPARATUS FOR MITIGATING PREMIX BURNER COMBUSTION TONE

(71) Applicant: Carrier Corporation, Palm Beach Gardens, FL (US)

(72) Inventor: Robert Shaw, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 337 days.

(21) Appl. No.: 16/842,359

(22) Filed: Apr. 7, 2020

(65) Prior Publication Data

US 2020/0318829 A1 Oct. 8, 2020

Related U.S. Application Data

(60) Provisional application No. 62/830,816, filed on Apr. 8, 2019.

(51) Int. Cl.
*F24C 15/36* (2006.01)
*F23N 5/20* (2006.01)
(Continued)

(52) U.S. Cl.
CPC ..... *F23N 5/203* (2013.01); *F23N 5/022* (2013.01); *F23N 5/16* (2013.01); *F23N 5/242* (2013.01); *F23N 2225/04* (2020.01); *F23N 2225/08* (2020.01); *F23N 2227/02* (2020.01); *F23N 2227/04* (2020.01); *F23N 2227/08* (2020.01); *F23N 2227/20* (2020.01); *F23N 2235/30* (2020.01)

(58) Field of Classification Search
CPC ..... F23N 5/203; F23N 5/022; F23N 5/16; F23N 5/242; F23N 2227/04; F23N 2227/20; F23N 2227/08; F23N 2227/02; F23N 2225/08; F23N 2225/04; F23N 2235/30
USPC ..... 431/29
See application file for complete search history.

(56) References Cited

U.S. PATENT DOCUMENTS 4,653,998 A 3/1987 Sohma et al.
6,343,927 B1 2/2002 Eroglu et al.
(Continued)

FOREIGN PATENT DOCUMENTS

WO 2018152394 A1 8/2018
WO 2019018675 A1 1/2019

*Primary Examiner* — Avinash A Savani
(74) *Attorney, Agent, or Firm* — Carlson, Gaskey & Olds, P.C.

(57) ABSTRACT

A method of calibrating a furnace includes determining a first flame stabilization period for the furnace that avoids detachment of a flame from a burner within a burner box of the furnace, determining a second flame stabilization period that is longer than the first flame stabilization period and avoids emission of a combustion tone from the furnace, and configuring a controller of the same or another furnace to utilize a flame stabilization period that has a duration between the first and second flame stabilization periods. Each flame stabilization period commences upon ignition of a premixed mixture of air and fuel at the burner while an inducer fan operates within a first range of fan speeds, and terminates when the rotational speed of the inducer fan increases to a second range speeds that is greater than the entire first range.

20 Claims, 5 Drawing Sheets

(51) Int. Cl.

| | |
|---|---|
| ***F23N 5/02*** | (2006.01) |
| ***F23N 5/16*** | (2006.01) |
| ***F23N 5/24*** | (2006.01) |

(56) References Cited

U.S. PATENT DOCUMENTS

| | | | | |
|---|---|---|---|---|
| 7,536,274 | B2 | 5/2009 | Heavner, III et al. | |
| 7,635,264 | B2 | 12/2009 | Strobel et al. | |
| 8,146,584 | B2 | 4/2012 | Thompson | |
| 8,167,610 | B2 | 5/2012 | Raleigh et al. | |
| 9,476,589 | B2 | 10/2016 | Newby | |
| 9,784,448 | B2 | 10/2017 | Bertelli | |
| 2008/0081301 | A1 | 4/2008 | Hannum et al. | |
| 2008/0318173 | A1 | 12/2008 | Schaller | |
| 2009/0317756 | A1 | 12/2009 | Hoverson et al. | |
| 2012/0135360 | A1 | 5/2012 | Hannum et al. | |
| 2013/0213378 | A1 | 8/2013 | Schultz | |
| 2014/0030662 | A1* | 1/2014 | Noman | F23N 5/203 431/114 |
| 2016/0003471 | A1 | 1/2016 | Karkow et al. | |
| 2017/0167725 | A1 | 6/2017 | Robertson | |
| 2018/0259199 | A1* | 9/2018 | Batson | F23L 17/005 |
| 2018/0259223 | A1 | 9/2018 | Reed et al. | |

* cited by examiner

METHOD AND APPARATUS FOR MITIGATING PREMIX BURNER COMBUSTION TONE

CROSS-REFERENCE TO RELATED APPLICATIONS

This application claims the benefit of Provisional Application No. 62/830,816, filed on Apr. 8, 2019, which is incorporated by reference herein in its entirety.

BACKGROUND

This application relates to furnaces, and more particularly relates to calibrating furnaces to avoid undesirable combustion tones.

Heating systems, such as residential and commercial furnaces, include one or more burners for combusting a fuel such as natural gas. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

One type of burner used in a furnace is a premix burner in which fuel and air are mixed in a burner inlet tube prior to injection into a combustion zone where the mixture is ignited. Compared to other burners (e.g. inshot burners), premix burners typically emit lower levels of nitrogen oxides (NOx), the emissions of which are tightly regulated and restricted by many jurisdictions.

During operation of a premix combustion furnace, it is possible that an undesirable combustion tone will occur that is unpleasant to those in the vicinity of the furnace. Unlike a normal "furnace roar" sound that sounds like white noise, is generally quiet, and only heard in proximity to the furnace, a "combustion tone" is more horn-like and can be heard throughout a home, for example. Such combustion tones would be considered unacceptable by a resident of a home in which the tone occurred.

SUMMARY

A method of calibrating a furnace according to an example of the present disclosure includes determining a first flame stabilization period for a furnace that avoids detachment of a flame from a burner within a burner box of the furnace, determining a second flame stabilization period that is longer than the first flame stabilization period and avoids emission of a combustion tone, and configuring a controller of the same or another furnace to utilize a third flame stabilization period that has a duration between the first and second flame stabilization periods. Each flame stabilization period commences upon ignition of a premixed mixture of air and fuel at the burner while an inducer fan that is in fluid communication with the burner box operates within a first range of fan speeds, and terminates when the rotational speed of the inducer fan increases to a second range of fan speeds that is greater than the entire first range.

In a further embodiment of any of the foregoing embodiments, said configuring a controller of the same or another furnace to utilize the third flame stabilization period that has a duration between the first and second flame stabilization periods includes determining a median of the first and second flame stabilization periods, and configuring the controller to use the median as the third flame stabilization period.

In a further embodiment of any of the foregoing embodiments, the furnace is cycled OFF and ON in each of a plurality of iterations, each iteration using a different respective one of a plurality of flame stabilization periods, as part of said determining a first flame stabilization period and said second flame stabilization period.

In a further embodiment of any of the foregoing embodiments, determining the first flame stabilization period includes determining a shortest flame stabilization period of the plurality of flame stabilization periods that avoids detachment of the flame from the burner.

In a further embodiment of any of the foregoing embodiments, determining the shortest flame stabilization period includes utilizing an initial flame stabilization period in a given iteration that causes detachment of a flame from the burner. The initial flame stabilization is increased in each of one or more subsequent iterations until a particular flame stabilization period is determined that avoids detachment of a flame from the burner. The particular flame stabilization period is selected as the first flame stabilization period.

In a further embodiment of any of the foregoing embodiments, determining the shortest flame stabilization period includes utilizing an initial flame stabilization period in a given iteration that avoids detachment of a flame from the burner. The initial flame stabilization is decreased in each of one or more subsequent iterations until a particular flame stabilization period of a particular iteration is determined that detaches of a flame from the burner. The flame stabilization period from the last iteration prior to the particular iteration is selected as the first flame stabilization period.

In a further embodiment of any of the foregoing embodiments, determining the second flame stabilization period includes determining a longest flame stabilization period of the plurality of flame stabilization periods that avoids emission of a combustion tone from the furnace.

In a further embodiment of any of the foregoing embodiments, determining the longest flame stabilization period includes utilizing an initial flame stabilization period in a given iteration that causes a combustion tone from the furnace, decreasing the initial flame stabilization period in each of one or more subsequent iterations until a particular flame stabilization period is determined that avoids emission of a combustion tone from the furnace, and selecting the particular flame stabilization period as the second flame stabilization period.

In a further embodiment of any of the foregoing embodiments, determining the longest flame stabilization period includes utilizing an initial flame stabilization period in a given iteration that avoids a combustion tone from the furnace, increasing the initial flame stabilization period in each of one or more subsequent iterations until a particular flame stabilization period of a particular iteration is determined that causes emission of a combustion tone from the furnace, and selecting the flame stabilization period from the last iteration prior to the particular iteration as the second flame stabilization period.

In a further embodiment of any of the foregoing embodiments, the following are performed during each iteration: turning ON an igniter, opening a gas valve of the furnace to provide a flow of gas to the burner while the igniter is turned ON, and detecting a flame from ignition of a premixed mixture of air and fuel at the burner, performed using a flame sensor that is spaced apart from the igniter.

In a further embodiment of any of the foregoing embodiments, during each iteration, the opening of the gas valve is performed after turning ON the igniter.

In a further embodiment of any of the foregoing embodiments, during each iteration, the inducer fan is operated within a third range of fan speeds to purge the burner box prior to turning ON the igniter and opening the gas valve.

In a further embodiment of any of the foregoing embodiments, the third range of fan speeds is greater than the entire first range of fan speeds and the entire second range of fan speeds.

In a further embodiment of any of the foregoing embodiments, during each iteration, the inducer fan is turned OFF after the purging, and turned ON within the first range of fan speeds after turning ON the igniter but before opening the gas valve.

In a further embodiment of any of the foregoing embodiments, during each iteration the rotational speed of the inducer fan is lowered from the third range of fan speeds for the purge to the first range of fan speeds for the flame stabilization period without turning OFF the inducer.

In a further embodiment of any of the foregoing embodiments, the furnace includes a heat exchanger, and the burner box is part of a burner assembly, and the method includes measuring a heat exchanger pressure drop (HXDP) across the heat exchanger and burner assembly. The first range of inducer fan speeds provides an HXDP at or within a predefined tolerance of a first HXDP target. The second range of inducer fan speeds provides an HXDP at or within a predefined tolerance of a second HXDP target that is greater than the first HXDP target.

In a further embodiment of any of the foregoing embodiments, during the flame stabilization period of each iteration, the first HXDP target is utilized as a setpoint, and the rotational speed of the inducer fan is adjusted based on the measured HXDP to approach the first HXDP target.

In a further embodiment of any of the foregoing embodiments, the controller is configured to utilize the second range of fan speeds for steady state operation of the furnace.

In a further embodiment of any of the foregoing embodiments, the mixture of air and fuel is premixed in the burner box, and the mixture is provided to the burner.

A furnace according to an example of the present disclosure includes a heat exchanger, a burner assembly, an inducer fan, and a controller. The burner assembly is in thermal communication with the heat exchanger, and includes a mixing tube that provides a premixed mixture of air and fuel to a burner. The inducer fan is operable to extract combustion gases from the burner. The controller is operable to control a rotational speed of the inducer fan to provide a flame stabilization period that commences upon ignition of the premixed mixture while the inducer fan operates within a first range of fan speeds, and terminates when the rotational speed of the inducer fan increases to a second range of fan speeds that is greater than the entire first range. The flame stabilization period has a duration that is long enough to avoid detachment of a flame from the burner and short enough to avoid emission of a combustion tone.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
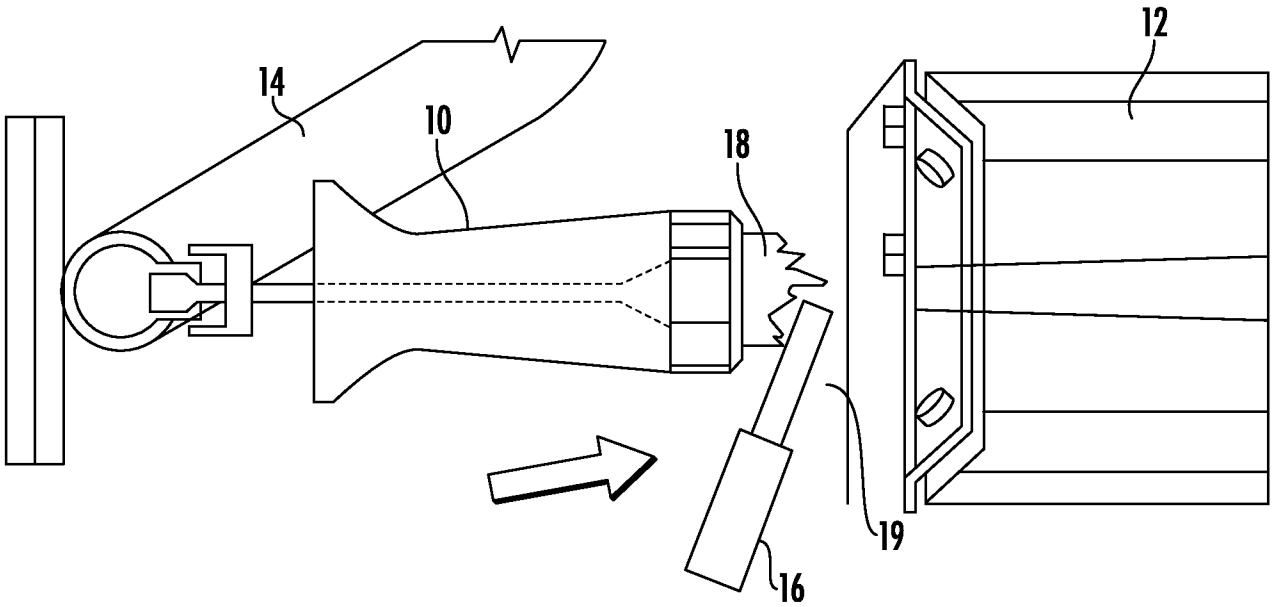
FIG. 1 PRIOR ART
FIG. 1 illustrates of a prior art inshot burner.

A typical prior art construction of a burner is shown in FIG. 1. A burner 10 is located external to a heat exchanger 12. The burner 10, generally referred to as an "inshot" burner 10, receives a flow of fuel from a fuel source 14. An ignition source 16 combusts the flow of fuel to create a combustion flame 18 in a combustion zone 19.

Figure 2:
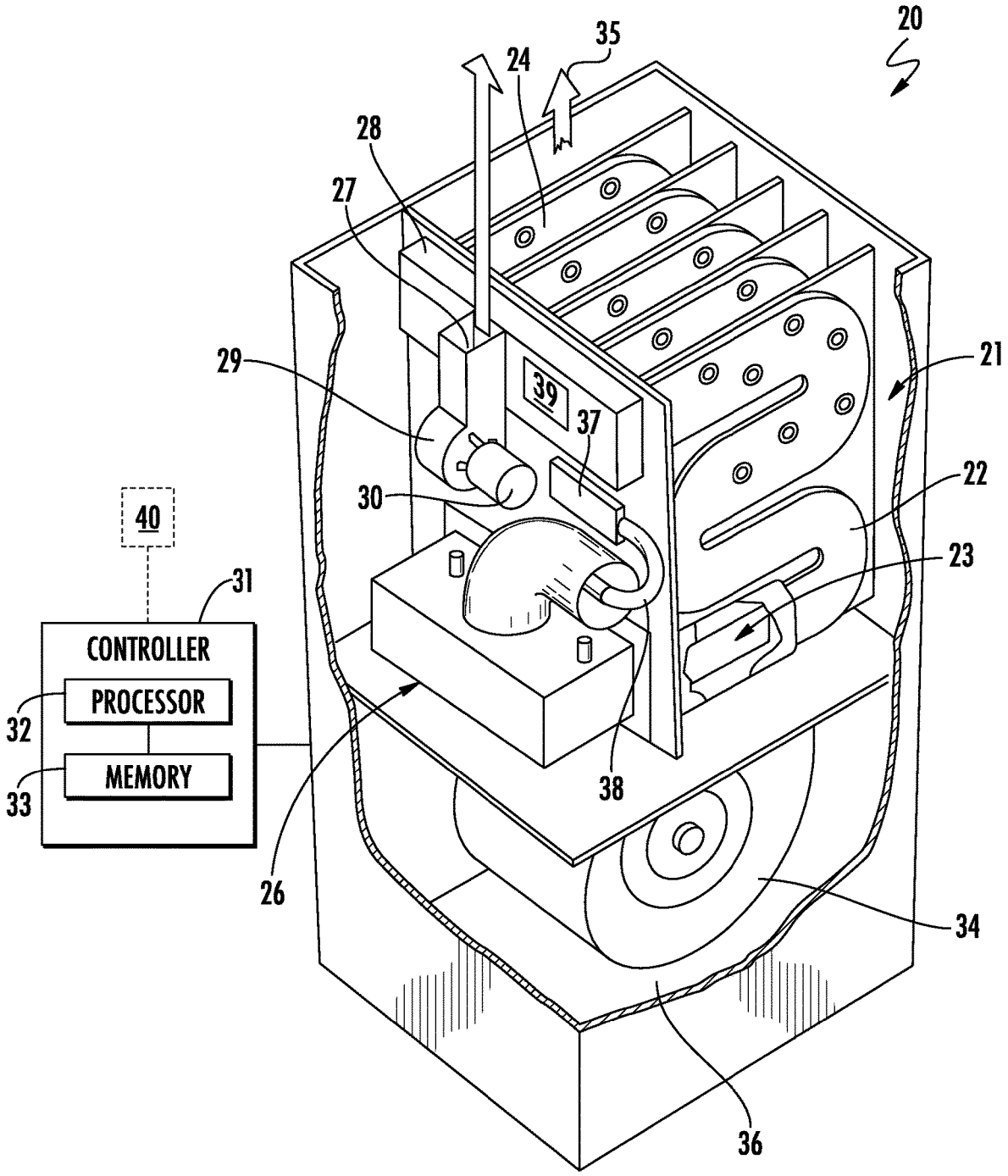
FIG. 2 illustrates a perspective view of an example furnace that utilizes premix combustion.

FIG. 2 illustrates a perspective view of an example furnace 20 that utilizes premix combustion. The furnace 20 includes a heat exchanger 21 having a plurality of individual heat exchanger coils 22. The heat exchanger coils 22 or "cells," which may be metallic conduits, may be provided in a serpentine fashion to provide a large surface area in a small overall volume of space. Each heat exchanger cell 22 includes a respective inlet 23 and a respective outlet 24 (one of each are labeled in FIG. 2). Each outlet 24 is in fluid communication with a collection box 28. A vent 27 is operatively associated with the collection box 28.

A burner assembly 26 is operatively associated with each inlet 23. A gas valve 37 controls a flow of gas from a source (not shown) through a conduit 38, to the burner assembly 26. The burner assembly 26 introduces a flame and combustion gases (not shown) into the heat exchanger cell 22. Vent 27 releases the combustion gases to atmosphere (through a flue or the like) after the heat of the flame and combustion gases are extracted by the heat exchanger 21 through collection box 28. Extraction of the combustion gases are aided by an inducer fan 29 having a motor 30. The motor 30 is controlled by a controller 31, which may be part of an integrated furnace control (IFC), for example.

The controller 31 includes a processor 32 operatively connected to memory 33. The processor 32 may include one or more microprocessors, microcontrollers, application specific integrated circuits (ASICs), or the like, for example. The memory 33 may include one or several types of memory such as read-only memory (ROM), random-access memory, cache memory, flash memory devices, etc.

In order to extract heat from the heat exchanger 21, an indoor blower assembly 34 may be provided to create significant airflow across the heat exchanger cells 22. As the air circulates across the cells 22, it is heated and can then be directed to a space to be heated, such as a home or commercial building for example, by way of appropriate ductwork as indicated by arrow 35. The furnace 20 may also include a return 36 to enable air from the space to be recirculated and/or fresh air to be introduced for flow across the heat exchanger cells 22.

A pressure transducer, schematically shown as 39, is provided to measure a heat exchanger pressure drop (HXDP) of the heat exchanger 21 and the burner assembly 26, and to output a signal representative of the pressure drop to the controller 31.

Operation of the inducer fan 29 contributes to the HXDP of the furnace 20, and the controller 31 has a mapping of inducer fan speeds to corresponding HXDP values stored in memory 33. The rotational speed of the inducer fan 29 can be controlled to achieve a desired HXDP (e.g., using the HXDP as a feedback in a closed loop control).

Optionally, an acoustic sensor 40 (shown in dotted lines) may also be provided that is configured to detect combustion tones and notify the controller 31 of such detected tones.

Figure 3:
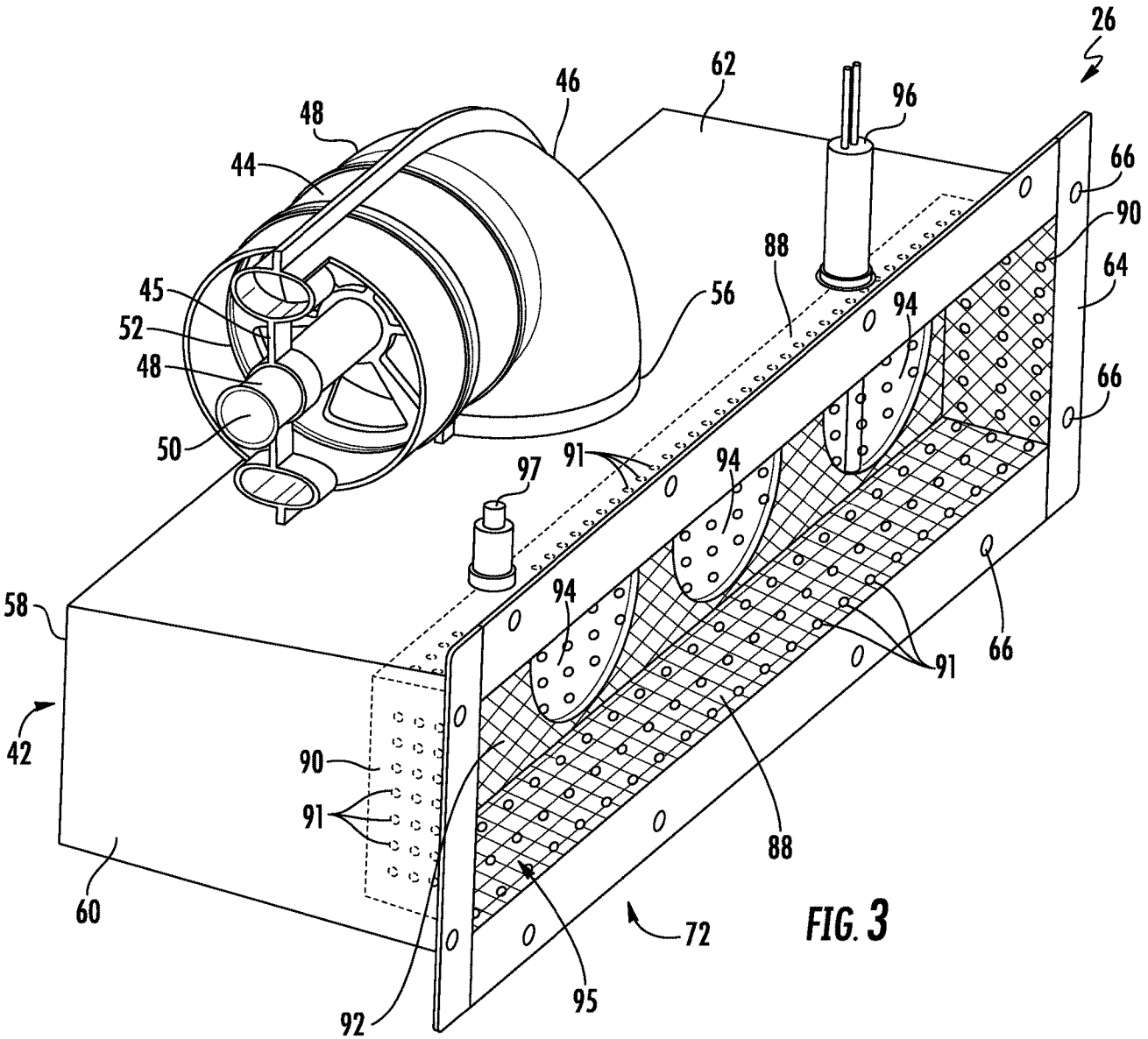
FIG. 3 a perspective view of an example burner assembly for the furnace of FIG. 2.

FIG. 3 illustrates an example burner assembly 26 for use in the furnace 20. In the illustrated example, the burner assembly 26 includes a burner box 42 in fluid communication with a mixing tube 44 that provides a mixture of air and fuel into the burner box 42 and then to a burner mesh 95 at an outlet of the burner box 42 for combustion.

In the illustrated example, the mixing tube 44 receives a supply of fuel and air from a fuel and air source, respectively. The fuel enters the mixing tube 44 through an inlet 50 to a fuel inlet tube 48 in fluid communication with the conduit 38, and the air enters to mixing tube 44 through an air inlet 52 that surrounds the fuel inlet tube 48. The mixing tube 44 also includes a mixing plate 45 that increases turbulence in the air entering the inlet 52 to encourage mixing of the air and fuel prior to an elbow 46 in the mixing tube 44 changing a direction of flow through the mixing tube 44 and into the burner box 42.

The air and fuel mixture continues to mix as it travels through the mixing tube 44 and into the burner box 42 through opening 56, and also continues to mix as it travels along an internal path (not shown) within the burner box 42 to a burner distribution plate 72.

The burner box 42 includes a back wall 58, a pair of opposite end walls 60, and a pair of opposite sidewalls 62. The end walls 60 and sidewalls 62 at least partially define an opening opposite the back wall 58 for accepting the burner distribution plate 72.

Referring again to FIG. 2, with continued reference to FIG. 3, the HXDP measured by transducer 39 represents a pressure drop across the heat exchanger 21 and the burner assembly 26. In one example, the transducer 39 includes a first input disposed downstream of the burner mesh 95 (e.g., with within the collection box 28) for measuring downstream pressure, and includes a second input disposed upstream of the burner distribution plate 72 (e.g., in an area within the furnace 20 from which air is drawn into the mixing tube 44 for premixing with fuel). As used herein, "upstream" refers to the flow path before the burner mesh 95, and "downstream" refers to the flow path after the burner mesh 95.

As shown in FIG. 3, the burner distribution plate 72 is accepted within the opening of the burner box 42 opposite the back wall 58. The burner distribution plate 72 includes a flange 64 surrounding a perimeter of the burner distribution plate 72 having attachment openings 66 that align with corresponding attachment openings in a flange on the burner box 42 (not shown).

The burner distribution plate 72 includes perforated sidewalls 88 and perforated end walls 90 that surround a partially perforated back wall 92. In the illustrated example, the back wall 82 includes multiple perforated discs 94 that protrude from the back wall 92 of the burner distribution plate 72. As shown in FIG. 3, a surface of the perforated side walls 88, perforated end walls 90, and the back wall 92 is covered in the burner mesh 95 (e.g., a wired gauze) that facilitates transition of the air-fuel mixture into a combustion region of the burner distribution plate 72. Although the burner mesh 95 is depicted as being on an outer surface of the sidewalls 88, end walls 90, and back wall 92, this is a non-limiting example, and the burner mesh 95 could instead be provided on an interior surface of these walls within the burner box 42.

An igniter 96 extends through the sidewall 62 shown in FIG. 3 at a first location and provides for igniting the premixed mixture of air and fuel. In one non-limiting example, the igniter 96 is a hot surface igniter. A flame sensor 97 extends through the sidewall 62 shown in FIG. 3 at a second location that is spaced apart from the first location. The flame sensor 97 is configured to detect ignition of a flame across the back wall 92, and output an electrical signal indicative of the flame to the controller 31.

Undesired combustion tones can occur in connection with furnace start-up based on differences in acoustical impedance and/or flue gas density. In general, a premix combustion system, such as that of the furnace 20, can be divided into two sub-systems when referring to the flow path of the fuel, air, flames and combustion byproducts (flue gases), with the burner mesh 95 serving as a divider. Both the upstream and downstream systems have corresponding acoustical impedance values, Z_upstream and Z_downstream. If Z_upstream is less that Z_downstream, then an undesirable combustion tone can occur. As used herein, a "combustion tone" refers to a horn-like tone from a premix burner furnace. "Combustion tone" does not include a typical "furnace roar" sound that occurs in all natural gas furnaces.

Also, immediately after ignition of the premixed mixture of air and fuel at the burner mesh 95 of the premix burner box 42, the combustion byproducts (flue gas) are relatively dense. The longer the burner box 42 burner operates, the density of the flue gas decreases (get thinner), until the furnace 20 reaches steady state operation where the flue gas density is no longer changing. During this transient flue gas density time period, the thermal acoustics of the entire combustion system can be affected in an undesirable manner and can produce an undesirable combustion tone.

Operation of the inducer fan 29 helps to reduce the density of flue gas. However, if the rotational speed of the inducer fan 29 is increased too rapidly, a flame from combustion of the premixed mixture at the burner mesh 95 may become detached from a burner portion of the burner box 42 (e.g., the burner mesh 95 itself), which is also undesirable. To avoid flame detachment, a "flame stabilization period" can be used to allow the flame to stabilize at the burner mesh 95. However, if the flame stabilization period is too long, an undesired combustion tone is more likely to occur.

Figure 4:
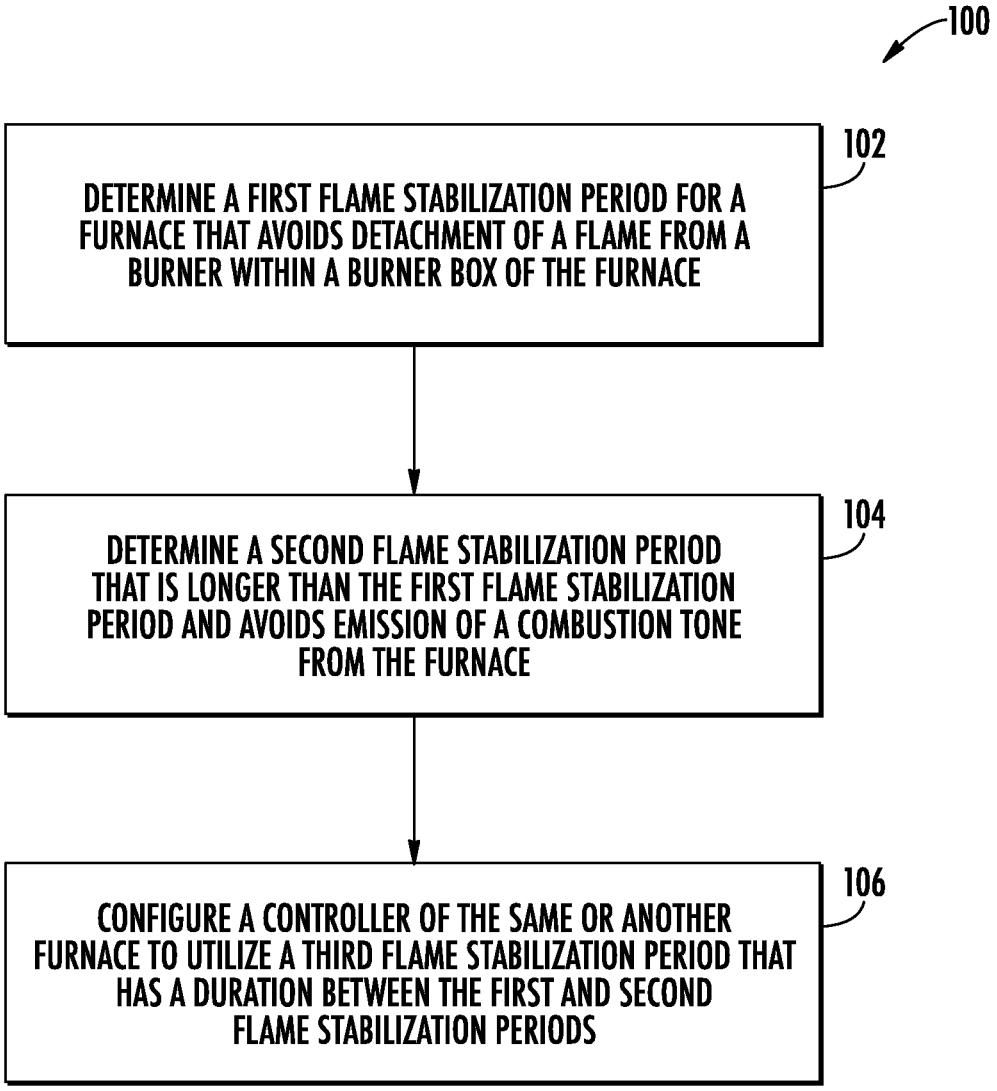
FIG. 4 is a flowchart representative of an example method of calibrating a furnace.

FIG. 4 is a flowchart 100 representative of a method of calibrating a furnace 20 to avoid the problems discussed above. A first flame stabilization period is determined for the furnace 20 that avoids detachment of a flame from a burner within the burner box 42 of the furnace 20 (e.g., the burner mesh 95 itself) (step 102). A second flame stabilization period is determined that is longer than the first flame stabilization period and avoids emission of a combustion tone from the furnace 20 (step 104). The controller 31 of the same furnace 20 or a controller 31 of another furnace (e.g., one of a same make and model as the one subject to the determinations of steps 102 and 104) is configured to utilize a third flame stabilization period that has a duration between the first and second flame stabilization periods (step 106).

Each flame stabilization period commences upon ignition of the mixture of air and fuel at the burner mesh 95 while the inducer fan 29 that is in fluid communication with the burner box 42 operates within a first range of fan speeds. Each flame stabilization period terminates when the rotational speed of the inducer fan 29 increases to a second range of fan speeds that is greater than the entire first range.

Determining and utilizing a flame stabilization time period as described in the method of flowchart 100 will reduce the transient flue gas density time period and a likelihood of occurrence of an undesired combustion tone.

In one example, the configuring of step 106 includes determining a median of the first and second flame stabilization periods, and configuring the controller 31 to use the median as the third flame stabilization period.

In one example, the method includes cycling the furnace 20 OFF and ON for each of a plurality of iterations, with each iteration using a different respective one of a plurality of flame stabilization periods to determine the first and second flame stabilization periods.

In one example, the determination of the first flame stabilization period (step 102) includes determining a shortest flame stabilization period of the plurality of flame stabilization periods from the iterations that avoids detachment of the flame from the burner mesh 95.

In the same or another example, the determination of the second flame stabilization period (step 104) includes determining a longest flame stabilization period of the plurality of flame stabilization periods that avoids emission of a combustion tone from the furnace 20.

In one example, determining the first flame stabilization period (step 102) includes utilizing an initial flame stabilization period in a given iteration that causes detachment of a flame from the burner mesh 95, increasing the initial flame stabilization in each of one or more subsequent iterations (e.g., by a same predefined amount interval in each iteration) until a particular flame stabilization period is determined that avoids detachment of a flame from the burner mesh 95, and that particular flame stabilization period is selected as the first flame stabilization period.

In another example, determining the first flame stabilization period (step 102) includes utilizing an initial flame stabilization period in a given iteration that avoids detachment of a flame from the burner mesh 95, decreasing the initial flame stabilization period in each of one or more subsequent iterations (e.g., by a same predefined interval in each iteration) until a particular flame stabilization period of a particular iteration is determined that detaches of a flame from the burner mesh 95, and selecting the flame stabilization period from the last iteration prior to the particular iteration as the first flame stabilization period.

One way to determine whether flame detachment occurs is based on a signal from the flame sensor 97, which has a different signal profile for a steady flame and a flame detachment scenario.

In one example, determining the second flame stabilization period (step 104) includes utilizing an initial flame stabilization period in a given iteration that causes a combustion tone from the furnace 20, decreasing the initial flame stabilization in each of one or more subsequent iterations (e.g., by a same predefined interval in each iteration) until a particular flame stabilization period is determined that avoids emission of a combustion tone from the furnace 20, and selecting the particular flame stabilization period as the second flame stabilization period.

In another example, said determining the second flame stabilization period (step 104) includes utilizing an initial flame stabilization period in a given iteration that avoids a combustion tone from the furnace 20, increasing the initial flame stabilization period in each of one or more subsequent iterations (e.g., by a same predefined interval in each iteration) until a particular flame stabilization period of a particular iteration is determined that causes emission of a combustion tone from the furnace 20, and selecting the flame stabilization period from the last iteration prior to the particular iteration as the second flame stabilization period.

The combustion tones can be detected by a human operator and/or by the acoustic sensor 40, for example.

In one example, during each iteration, the igniter 96 is turned ON from an OFF state and the gas valve 37 is turned ON from an OFF state to provide a flow of gas to the burner mesh 95 (which is premixed with air within the mixing tube 44 and within the burner box 42). A flame from ignition of the premixed mixture is detected by the flame sensor 97, which is spaced apart from the igniter 96.

Figure 5:
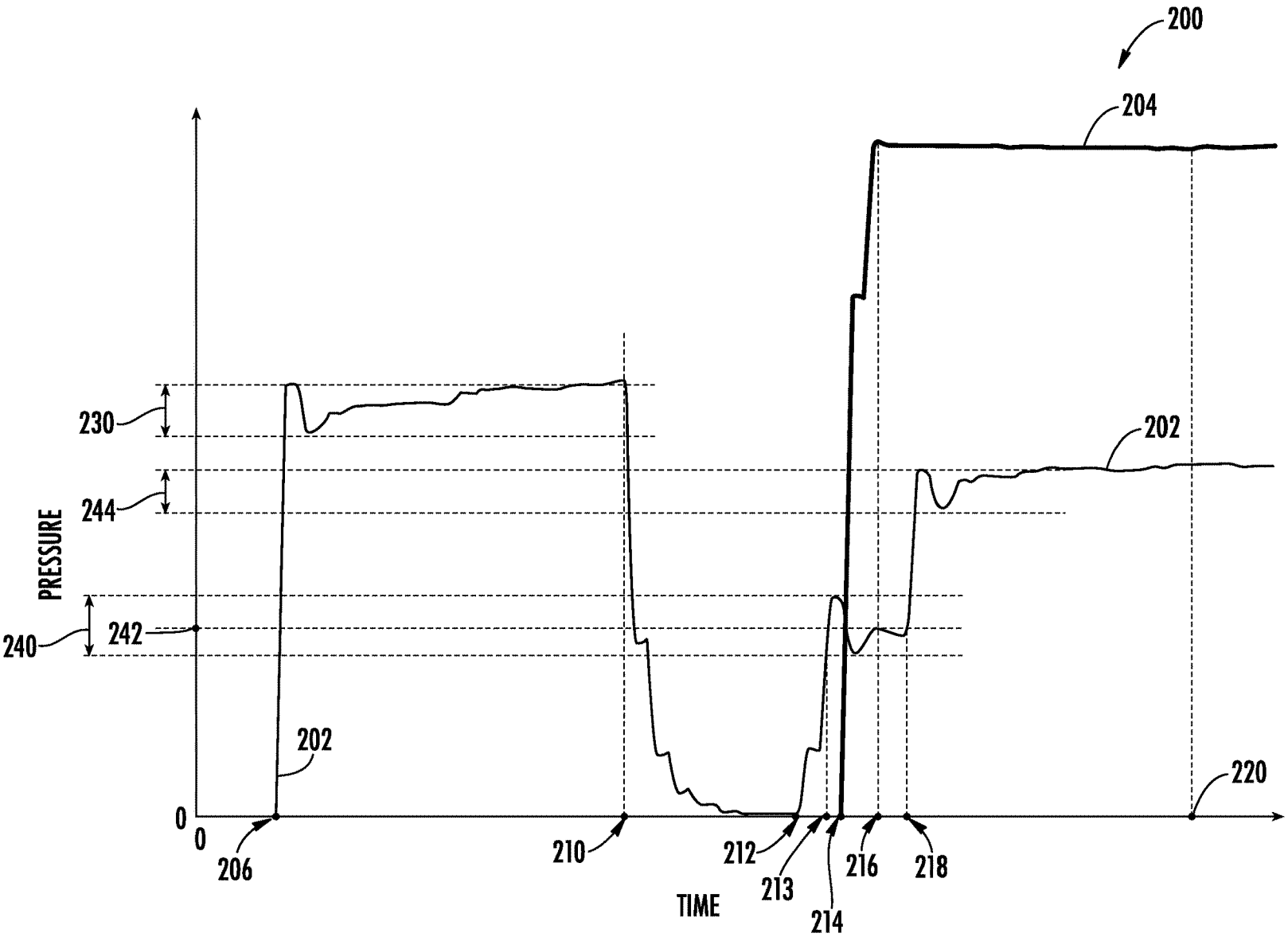
FIG. 5 is a graph depicting changes in inducer fan speed over time.

FIG. 5 is a graph 200 depicting changes in rotational speed of the inducer fan 29 over time. In the graph 200, the X-axis represents time, and the Y-axis represents an HXDP as measured by the transducer 39, which is a negative pressure. The negative pressure may be measured in units of inches water column, for example. In the graph 200, a plot 202 represents an HXDP value measured by the transducer 39, and a plot 204 represents a positive pressure of pressure in the gas conduit 38, a magnitude of which is superimposed on the graph 200 for reference (despite being a non-negative pressure).

Operation of the inducer fan 29 contributes to the HXDP of the furnace 20, and the controller 31 has a mapping of inducer fan speeds to corresponding HXDP values stored in memory 33. The rotational speed of the inducer fan 29 can be controlled to achieve a desired HXDP.

At a time 206, the inducer fan 29 is turned ON and initiated to operate in a range of fan speeds corresponding to HXDP window 230 in FIG. 5. This provides for pre-purging the heat exchanger 21 and burner assembly 26 (e.g., of flue gases from previous combustion) and/or to for pre-purging debris that may have accumulated in the vent 27. This warmup of the inducer fan 29 also serves as a safety check to make sure that the inducer fan 29 is operating properly.

During operation of the inducer fan 29, the output of the pressure transducer 39 serves as an input for a closed loop feedback input for the controller 31 to adjust the inducer fan 29 speed as needed to approach and/or meet a given HXDP target/window.

At time 210, the hot surface igniter 96 is turned ON for warmup. Also, the inducer fan 29 can optionally be turned off at time 210.

At time 212, a rotational speed of the inducer fan 29 is increased to operate within a range of rotational speeds corresponding to the HXDP window 240 (e.g., based and/or centered on a setpoint 242). In the example of FIG. 5, this involves turning ON the inducer fan 29 and increasing its speed. Alternatively, if the inducer fan 29 was not turned off at time 210, this could include lowering the speed of the inducer fan 29 to be within the range corresponding to HXDP window 240.

At time 213, the HXDP overshoots the setpoint 242, after which the inducer fan 29 speed and HXDP are reduced to the setpoint at time 214.

The gas valve 37 is opened at time 214, and ignition is detected by the flame sensor 97 at time 216. Thus, in the example of FIG. 5, the opening of the gas valve 37 is performed after turning on the igniter 96.

From time 213 to time 218, the inducer fan 29 continues to operate within the range corresponding to HXDP window 240 of values corresponding to HXDP window 240, but at time 218 the rotational speed of the inducer fan 29 is increased to a range of values corresponding to HXDP window 244.

In the example of FIG. 5, the HXDP window 244 is greater than and non-overlapping with the entire HXDP window 240, and the range of inducer fan speeds corresponding to the HXDP window 244 is greater than and non-overlapping with the entire range of inducer fan speeds corresponding to the HXDP window 240.

Also, in the example of FIG. 5, the HXDP window 230 is greater than and non-overlapping with the HXDP window 244, and the range of inducer fan speeds corresponding to the HXDP window 230 is greater than and non-overlapping with the entire range of inducer fan speeds corresponding to the HXDP window 244.

In one example, each window 230, 240, 244 is centered around a respective setpoint (e.g., within a predefined tolerance of its respective setpoint).

The "flame stabilization period" of FIG. 4 is used to determine when to increase the rotational speed of the inducer fan 29 from the range corresponding to HXDP window 240 to the range corresponding to HXDP window 244. In one example, the flame stabilization period initiates at time 216 when a flame is detected, and terminates at time 218 when the rotational speed of the inducer fan 29 is ramped up.

In one example, time 0 indicates the start of an iteration of the method 100, and time 220 indicates an example time at which a given iteration could be terminated, after which the inducer fan 29, gas valve 37, and igniter 96 can be turned OFF prior to turning ON again as part of a subsequent iteration.

The example of FIG. 5 does not depict the termination of an iteration at time 220. Instead, FIG. 5 depicts the furnace 20 operating at steady state with a steady state HXDP shown on the plot 202 at time 220 (corresponding to the window 244), and a steady state gas conduit 38 pressure shown in plot 204 at time 220. Nevertheless, it is understood that time 220 could serve as the terminating point for an iteration.

The same HXDP target 242 could be used as a setpoint for adjusting the fan speed of the inducer fan 29 during the flame stabilization period of each subsequent iteration of the method 100.

The method of flowchart 100 provides the benefit of maintaining a short flame stabilization time period that reduces the transient flue gas density time period, thereby preventing premix combustion tones, and also avoiding flame detachment.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A method of calibrating a furnace, comprising:

determining a first flame stabilization period for a furnace that avoids detachment of a flame from a burner within a burner box of the furnace;

determining a second flame stabilization period that is longer than the first flame stabilization period and avoids emission of a combustion tone; and configuring a controller of the same or another furnace to utilize a third flame stabilization period that has a duration between the first and second flame stabilization periods;

wherein each flame stabilization period commences upon ignition of a premixed mixture of air and fuel at the burner while an inducer fan that is in fluid communication with the burner box operates within a first range of fan speeds, and terminates when the rotational speed of the inducer fan increases to a second range of fan speeds that is greater than the entire first range.

2. A method of calibrating a furnace, comprising:

determining a first flame stabilization period for a furnace that avoids detachment of a flame from a burner within a burner box of the furnace;

determining a second flame stabilization period that is longer than the first flame stabilization period and avoids emission of a combustion tone; and configuring a controller of the same or another furnace to utilize a third flame stabilization period that has a duration between the first and second flame stabilization periods;

wherein each flame stabilization period commences upon ignition of a premixed mixture of air and fuel at the burner while an inducer fan that is in fluid communication with the burner box operates within a first range of fan speeds, and terminates when the rotational speed of the inducer fan increases to a second range of fan speeds that is greater than the entire first range; and wherein the method includes cycling the furnace OFF and ON in each of a plurality of iterations, each iteration using a different respective one of a plurality of flame stabilization periods, as part of said determining a first flame stabilization period and said second flame stabilization period.

3. The method of claim 2, wherein said determining the first flame stabilization period comprises determining a shortest flame stabilization period of the plurality of flame stabilization periods that avoids detachment of the flame from the burner.

4. The method of claim 3, wherein said determining the shortest flame stabilization period comprises:

utilizing an initial flame stabilization period in a given iteration that causes detachment of a flame from the burner;

increasing the initial flame stabilization in each of one or more subsequent iterations until a particular flame stabilization period is determined that avoids detachment of a flame from the burner; and selecting the particular flame stabilization period as the first flame stabilization period.

5. The method of claim 3, wherein said determining the shortest flame stabilization period comprises:

utilizing an initial flame stabilization period in a given iteration that avoids detachment of a flame from the burner;

decreasing the initial flame stabilization in each of one or more subsequent iterations until a particular flame stabilization period of a particular iteration is determined that detaches of a flame from the burner; and selecting the flame stabilization period from the last iteration prior to the particular iteration as the first flame stabilization period.

6. The method of claim 2, wherein said determining the second flame stabilization period comprises determining a longest flame stabilization period of the plurality of flame stabilization periods that avoids emission of a combustion tone from the furnace.

7. The method of claim 6, wherein said determining the longest flame stabilization period comprises:

utilizing an initial flame stabilization period in a given iteration that causes a combustion tone from the furnace;

decreasing the initial flame stabilization period in each of one or more subsequent iterations until a particular flame stabilization period is determined that avoids emission of a combustion tone from the furnace; and selecting the particular flame stabilization period as the second flame stabilization period.

8. The method of claim 6, wherein said determining the longest flame stabilization period comprises:

utilizing an initial flame stabilization period in a given iteration that avoids a combustion tone from the furnace;

increasing the initial flame stabilization period in each of one or more subsequent iterations until a particular flame stabilization period of a particular iteration is determined that causes emission of a combustion tone from the furnace; and selecting the flame stabilization period from the last iteration prior to the particular iteration as the second flame stabilization period.

9. The method of claim 2, comprising performing the following during each iteration:

turning ON an igniter;

opening a gas valve of the furnace to provide a flow of gas to the burner while the igniter is turned ON; and detecting a flame from ignition of a premixed mixture of air and fuel at the burner, said detecting performed using a flame sensor that is spaced apart from the igniter.

10. The method of claim 9, wherein during each iteration, said opening the gas valve is performed after said turning ON the igniter.

11. The method of claim 9, comprising during each iteration:

operating the inducer fan within a third range of fan speeds to purge the burner box prior to said turning ON the igniter and said opening the gas valve.

12. The method of claim 11, wherein the third range of fan speeds is greater than the entire first range of fan speeds and the entire second range of fan speeds.

13. The method of claim 11, comprising:

during each iteration, turning OFF the inducer fan after said purging, and turning ON the inducer fan within the first range of fan speeds after said turning ON the igniter but before said opening the gas valve.

14. The method of claim 11, comprising:

during each iteration, lowering the rotational speed of the inducer fan from the third range of fan speeds for the purge to the first range of fan speeds for the flame stabilization period without turning OFF the inducer fan.

15. The method of claim 1, wherein the furnace includes a heat exchanger, and the burner box is part of a burner assembly, the method comprising:

measuring a heat exchanger pressure drop (HXDP) across the heat exchanger and burner assembly;

wherein the first range of inducer fan speeds provides an HXDP at or within a predefined tolerance of a first HXDP target; and wherein the second range of inducer fan speeds provides an HXDP at or within a predefined tolerance of a second HXDP target that is greater than the first HXDP target.

16. The method of claim 15, comprising, during the flame stabilization period of each iteration:

utilizing the first HXDP target as a setpoint; and adjusting the rotational speed of the inducer fan based on the measured HXDP to approach the first HXDP target.

17. The method of claim 2, comprising:

configuring the controller to utilize the second range of fan speeds for steady state operation of the furnace.

18. The method of claim 2, comprising:

premixing the mixture of air and fuel in the burner box; and providing the mixture to the burner.

19. A furnace comprising:

a heat exchanger;

a burner assembly in thermal communication with the heat exchanger, the burner assembly including a mixing tube that provides a premixed mixture of air and fuel to a burner in a burner box;

an inducer fan operable to extract combustion gases from the burner; and a controller operable to:

determine a first flame stabilization period for a furnace that avoids detachment of a flame from the burner;

determine a second flame stabilization period that is longer than the first flame stabilization period and avoids emission of a combustion tone; and cycle the furnace OFF and ON in each of a plurality of iterations, each iteration using a different respective one of a plurality of flame stabilization periods, as part of the determination of the first flame stabilization period and the second flame stabilization period; and utilize a third flame stabilization period that has a duration between the first and second flame stabilization periods;

wherein each flame stabilization period commences upon ignition of a premixed mixture of air and fuel at the burner while an inducer fan that is in fluid communication with the burner box operates within a first range of fan speeds, and terminates when the rotational speed of the inducer fan increases to a second range of fan speeds that is greater than the entire first range.

20. The method of claim 2, wherein said configuring a controller of the same or another furnace to utilize the third flame stabilization period that has a duration between the first and second flame stabilization periods comprises: determining a median of the first and second flame stabilization periods; and configuring the controller to use the median as the third flame stabilization period.

* * * * *